US007082271B2

(12) United States Patent
Nakamura et al.

(10) Patent No.: US 7,082,271 B2
(45) Date of Patent: Jul. 25, 2006

(54) IMAGE FORMING APPARATUS AND IMAGE FORMING METHOD USING LIQUID DEVELOPMENT

(75) Inventors: Masahide Nakamura, Nagano-ken (JP); Yoshiro Koga, Nagano-ken (JP); Toru Fujita, Nagano-ken (JP); Atsunori Kitazawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 10/693,648

(22) Filed: Oct. 27, 2003

(65) Prior Publication Data

US 2004/0136739 A1 Jul. 15, 2004

(30) Foreign Application Priority Data

Nov. 1, 2002 (JP) ..... 2002-320259
Nov. 1, 2002 (JP) ..... 2002-320260

(51) Int. Cl.
*G03G 15/00* (2006.01)
*G03G 15/10* (2006.01)

(52) U.S. Cl. ..... 399/49; 399/57
(58) Field of Classification Search ..... 399/49, 399/57
See application file for complete search history.

(56) References Cited

U.S. PATENT DOCUMENTS

| | | | |
|---|---|---|---|
| 4,950,905 | A | 8/1990 | Butler et al. |
| 5,512,978 | A | 4/1996 | Mosher et al. |
| 5,706,095 | A | 1/1998 | Rathbun |
| 6,115,561 | A | 9/2000 | Fukushima |
| 6,287,741 | B1 | 9/2001 | Marko |

FOREIGN PATENT DOCUMENTS

| | | | |
|---|---|---|---|
| CN | 1372654 | | 10/2002 |
| JP | 06236078 | A * | 8/1994 |
| JP | 8-292622 | A | 11/1996 |
| JP | 10-39555 | A | 2/1998 |
| JP | 11-65295 | | 3/1999 |

* cited by examiner

*Primary Examiner*—Arthur T. Grimley
*Assistant Examiner*—Ryan Gleitz
(74) *Attorney, Agent, or Firm*—Sughrue Mion, PLLC

(57) ABSTRACT

A CPU 113 executes a control program stored in a memory 116, whereby a patch image is formed on a photosensitive member of a photosensitive member unit 10, a light emitter 171 irradiates light upon the patch image, a light receiver 172 receives light from the patch image, whether a received-light signal from the light receiver 172 is within a tolerable range is determined, and an image forming condition is controlled and stored in the memory 116 when the received-light signal is outside the tolerable range. Upon entry of a print instruction signal from an external apparatus via a main controller 100, a printing operation is executed under the image forming condition stored in the memory 116.

3 Claims, 15 Drawing Sheets

PRIOR ART

PRIOR ART

PRIOR ART

IMAGE FORMING APPARATUS AND IMAGE FORMING METHOD USING LIQUID DEVELOPMENT

BACKGROUND OF THE INVENTION

1. Field of the Invention

The present invention relates to an electrophotographic image forming technique such as a printer, a copier machine and a facsimile machine, and more particularly, to an electrophotographic image forming technique which utilizes liquid development as a development method.

2. Description of the Related Art

Such an electrophotographic image forming apparatus has already been commercialized in which exposure means exposes a charged photosensitive member to thereby form an electrostatic latent image on the photosensitive member, developing means makes toner adhere to the photosensitive member, visualizes the electrostatic latent image and accordingly forms a toner image, and the toner image is then transferred onto a transfer medium. As a development method for the developing means, a liquid development method is known which uses a liquid developer which is obtained by dispersing toner in a carrier liquid. As advantages of the liquid development method, it is possible to obtain a high-resolution image owing to a small average particle diameter of toner which is as small as 0.1 through 2 μm, it is possible to obtain uniform images because of a high liquidity of the liquid developer, etc.

As known in the art, in this image forming apparatus, an image quality such as an image density can be controlled by changing image forming conditions which are defined by various factors, such as bias potentials applied upon respective portions of the apparatus. Further, the image density of a toner image may change depending on a difference between individual apparatuses, a change with time, a change in environment surrounding the apparatus such as a temperature and a humidity level, etc. Noting this, a density controlling technique has been proposed which controls an image density by adjusting an image forming condition which influences the image density among the factors mentioned above. In an apparatus described in Japanese Patent Application Laid-Open Gazette No. H8-292622 of 1996 for example, a test patch image is formed, light is irradiated upon the patch image, light from the patch image is received, the image density of the patch image is detected, and image forming conditions such as a surface potential of the photosensitive member and the toner density of the liquid developer are controlled based on the detected result.

By the way, while conventional image forming apparatuses have used a liquid developer having a relatively low toner density, liquid developers having relatively high toner densities have started to be used over the recent years for the following reasons. One of the reasons is that it is difficult to reduce the size of an apparatus since a large amount of a liquid developer is necessary to ensure a sufficient amount of toner as the liquid developer has a low toner density. Another reason is that the structure of the apparatus becomes complex in an effort to prevent a volatile solvent often used as a carrier liquid from leaking out of the apparatus. Further, when a liquid developer has a high toner density, the viscosity of the liquid developer increases. Hence, it is difficult to apply the density controlling technique described in Japanese Patent Application Laid-Open Gazette No. H8-292622 which is on a premise to use a liquid developer having a relatively low toner density directly to an image forming apparatus which uses a liquid developer having a relatively high toner density and a high viscosity.

SUMMARY OF THE INVENTION

Accordingly, an object of the present invention is to provide an image forming apparatus and an image forming method wherein a toner image is formed by developing a latent image on a latent image carrier using a high density/high viscosity liquid developer and is transferred onto a transfer medium, the apparatus and method which is capable of forming an image which has an excellent image quality in a stable manner.

According to a first aspect of the present invention, there is provided an image forming apparatus wherein a latent image on a latent image carrier is developed using a liquid developer, in which toner particles are dispersed in a carrier liquid and of which toner density is about 5 through 40 wt %, thereby forming a toner image, and the toner image is transferred onto a transfer medium, the apparatus comprising: an optical sensor including a light emitter which irradiates light upon a toner image formed as a patch image on the latent image carrier, and a light receiver which receives light from the patch image; and control means controlling an image forming condition which influences a toner image density based on a received-light signal from the light receiver.

According to a second aspect of the present invention, there is provided an image forming apparatus, comprising: a latent image carrier structured to carry a latent image on its surface; a liquid developer carrier which transports, to a developing position facing the latent image carrier, a liquid developer in which toner particles are dispersed in a carrier liquid and of which toner density is about 5 through 40 wt %, while carrying the liquid developer on its surface, brings the liquid developer into contact with the latent image carrier at the developing position, thereby supplying the liquid developer to the latent image carrier; image forming means which makes the toner particles contained in the liquid developer supplied to the latent image carrier from the liquid developer carrier adhere to the latent image carrier, thereby visualizing the latent image and forming a toner image; transfer means which transfers the toner image on the latent image carrier onto a transfer medium at a predetermined transfer position; an optical sensor including a light emitter which irradiates light upon a toner image as a patch image transferred onto the transfer medium, and a light receiver which receives light from the patch image; and control means controlling an image forming condition which influences a toner image density based on a received-light signal from the light receiver.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

<First Preferred Embodiment>

Figure 1:
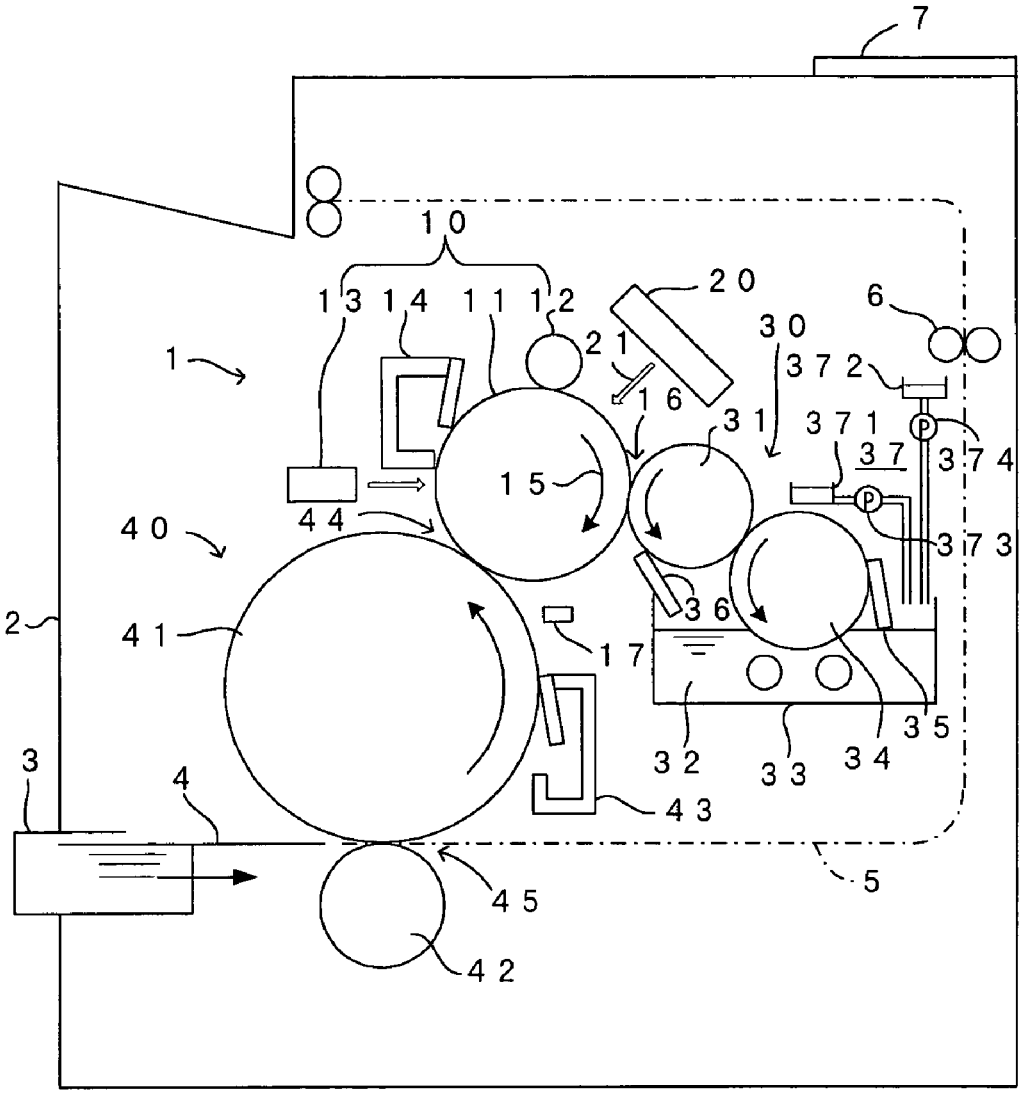
FIG. 1 is a drawing which shows an internal structure of a printer which is a first preferred embodiment of the present invention.
Figure 2:
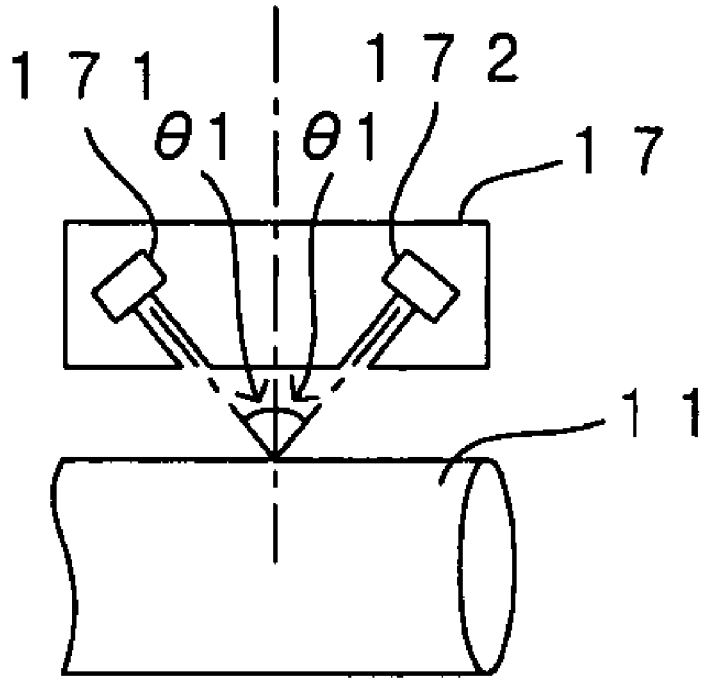
FIG. 2 is a drawing of a patch sensor which is disposed facing a photosensitive member.
Figure 3:
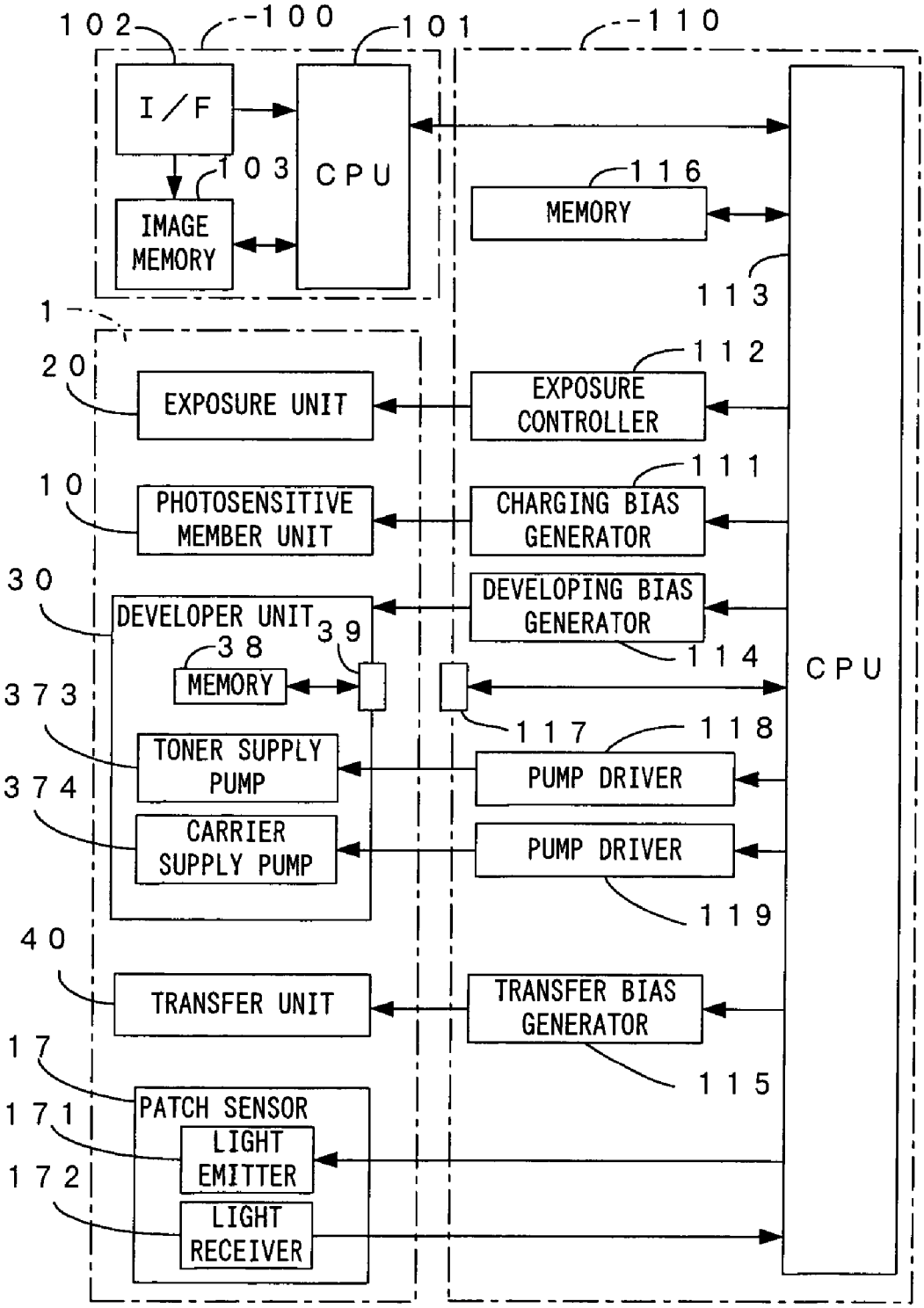
FIG. 3 is a block diagram which shows an electric structure of this printer.

FIG. 1 is a drawing which shows an internal structure of a printer which is a first preferred embodiment of the present invention, FIG. 2 is a drawing of a patch sensor which is disposed facing a photosensitive member, and FIG. 3 is a block diagram which shows an electric structure of this printer.

This printer is an image forming apparatus of the liquid development type which forms a monochrome image using a liquid developer containing black (K) toner. As a print instruction signal containing an image signal is fed to a main controller 100 from an external apparatus such as a host computer, an engine controller 110 controls respective portions of an engine section 1 in accordance with a control signal received from the main controller 100, and images which correspond to the image signal mentioned above are printed on a transfer paper, a copy paper and other general paper (hereinafter referred to as a "recording medium") 4 transported from a paper cassette 3 which is disposed in a lower portion of an apparatus body 2.

The engine section 1 mentioned above comprises a photosensitive member unit 10, an exposure unit 20, a developer unit 30, a transfer unit 40, etc. Of these units, the photosensitive member unit 10 comprises a photosensitive member 11, a charger 12, a static eliminator 13 and a cleaner 14. The developer unit 30 comprises a developer roller 31 and the like. Further, the transfer unit 40 comprises an intermediate transfer roller 41 and the like.

In the photosensitive member unit 10, the photosensitive member 11 is disposed for free rotations in the arrow direction 15 shown in FIG. 1 (i.e., in the clockwise direction in FIG. 1). Disposed around the photosensitive member 11 are the charger 12, the developer roller 31, the intermediate transfer roller 41, the static eliminator 13 and the cleaner 14 along the rotation direction 15 of the photosensitive member 11. A surface area between the charger 12 and the developer roller 31 serves as an irradiation area of a light beam 21 from the exposure unit 20. The charger 12 is formed by a charger roller in this embodiment. Applied with a charging bias from a charging bias generator 111, the charger 12 uniformly charges an outer circumferential surface of the photosensitive member 11 to a predetermined surface potential Vd (e.g., Vd=DC+600 V), thus functioning as charging means.

The exposure unit 20 emits the light beam 21, which is laser for instance, toward the outer circumferential surface of the photosensitive member 11 which is uniformly charged by the charger 12. The-exposure unit 20 exposes the photosensitive member 11 with the light beam 21 in accordance with a control instruction which is fed from an exposure controller 112, so as to form an electrostatic latent image which corresponds to an image signal on the photosensitive member 11, thus functioning as exposure means. For instance, when a print instruction signal containing an image signal is fed to a CPU 101 of the main controller 100 via an interface 102 from an external apparatus such as a host computer, in response to an instruction from the CPU 101 of the main controller 100, a CPU 113 outputs a control signal which corresponds to the image signal to the exposure controller 112 at predetermined timing. The exposure unit 20 then irradiates the light beam 21 upon the photosensitive member 11 in accordance with the control instruction received from the exposure controller 112, and an electrostatic latent image which corresponds to the image signal is formed on the photosensitive member 11. To form a patch image when the need arises, the CPU 113 provides the exposure controller 112 with a control signal corresponding to a patch image signal representing a predetermined pattern (e.g., a solid image) which has been set in advance, and an electrostatic latent image which corresponds to the pattern is formed on the photosensitive member 11. In this embodiment, the photosensitive member 11 thus corresponds to a "latent image carrier" of the present invention.

Thus formed electrostatic latent image is visualized with a toner which is supplied by means of the developer roller 31 of the developer unit 30. The developer unit 30 comprises, in addition to the developer roller 31, a tank 33 which holds a liquid developer 32, a coating roller 34 which scoops up the liquid developer 32 stored in the tank 33 and supplies the liquid developer 32 to the developer roller 31, a restricting blade 35 which restricts the thickness of a layer of the liquid developer on the coating roller 34 into uniform thickness, a cleaning blade 36 which removes the liquid developer which remains on the developer roller 31 after the toner has been supplied to the photosensitive member 11, a toner density adjuster 37 and a memory 38 (FIG. 3) which will be described later. The developer roller 31 rotates approximately at the same circumferential speed as the photosensitive member 11 in a direction which follows the photosensitive member 11 (the anti-clockwise direction in FIG. 1). The coating roller 34 rotates approximately at double the circumferential speed in the same direction as the developer roller 31 (i.e., in the anti-clockwise direction in FIG. 1).

The liquid developer 32 is obtained by dispersing, within a carrier liquid, toner which is formed by a color pigment, an adhesive agent such as an epoxy resin which bonds the color pigment, an electric charge control agent which gives a predetermined charge to the toner, a dispersing agent which uniformly disperses the color pigment, etc. In this embodiment, silicon oil such as polydimethyl siloxane oil is used as the carrier liquid, and a toner density is 5 through 40 wt % which is a higher density than that of a low-density liquid developer which is often used in the liquid development (and whose toner density is 1 through 2 wt %). The type of the carrier liquid is not limited to silicon oil. The viscosity of the liquid developer 32 is determined by the carrier liquid used, materials which forms toner, a toner density, etc. In this embodiment, the viscosity is 100 through 10000 mPa·s and preferably 50 through 6000 mPa·s for example, which is higher than that of a low-density liquid developer.

A gap between the photosensitive member 11 and the developer roller 31 (i.e., a development gap=the thickness of the liquid developer layer) is set to 5 through 40 μm for instance in this embodiment. A development nip distance (which is a distance along a circumferential direction over which the liquid developer layer contacts both the photosensitive member 11 and the developer roller 31) is set to 5 mm for instance in this embodiment. As compared with where a low-density liquid developer mentioned above is used and therefore a development gap of 100 through 200 μm is demanded so as to secure a toner amount, this embodiment which uses a high-density liquid developer allows to shorten the development gap. Since this in turn shortens a travel of the toner which moves within the liquid developer because of electrophoresis and permits to generate a higher electric field even at the same developing bias, it is possible to improve the developing efficiency and the development is performed at a high speed.

The toner density adjuster 37 comprises a supply tank 371, which holds a liquid developer whose toner density is higher than that of the liquid developer 32 held in the tank 33, and a supply tank 372 which holds the carrier liquid mentioned above. As a toner supply pump 373 operates, the high-density liquid developer is supplied from the supply tank 371 to the tank 33, thereby increasing the toner density in the liquid developer 32. Meanwhile, when a carrier supply pump 374 operates, the carrier liquid is supplied from the supply tank 372 to the tank 33, thereby decreasing the toner density in the liquid developer 32. Pump drivers 118 and 119 drive the pumps 373 and 374. As the operations of the pumps 373 and 374 are thus controlled, the toner density in the liquid developer 32 inside the tank 33 is adjusted.

In the developer unit 30 having such a structure, the coating roller 34 scoops up the liquid developer 32 which is held in the tank 33 and the restricting blade 35 restricts the thickness of the liquid developer layer on the coating roller 34 into uniform thickness. The uniform liquid developer 32 adheres to a surface of the developer roller 31, and as the developer roller 31 rotates, the liquid developer 32 is transported to the developing position 16 facing the photosensitive member 11. Toner is charged positively for example at all times owing to a function of the electric charge control agent and the like. At the developing position 16 therefore, the toner moves toward the photosensitive member 11 from the developer roller 31 because of a developing bias Vb (e.g., Vb=DC+400 V) which is applied upon the developer roller 31 by a developing bias generator 114, and an electrostatic latent image is accordingly visualized.

A toner image which is thus formed on the photosensitive member 11 is transported to a primary transfer position 44 which is faced against the intermediate transfer roller 41, as the photosensitive member 11 rotates. The intermediate transfer roller 41 rotates approximately at the same circumferential speed as the photosensitive member 11 in a direction which follows the photosensitive member 11 (the anti-clockwise direction in FIG. 1). When a transfer bias generator 115 applies a primary transfer bias (which may be DC−400 V for instance), the toner image on the photosensitive member 11 is primarily transferred onto the intermediate transfer roller 41. The static eliminator 13 formed by an LED or the like removes an electric charge remaining on the photosensitive member 11 after the primary transfer, and the cleaner 14 removes the liquid developer which remains. In this embodiment, the intermediate transfer roller 41 thus corresponds to a "transfer medium" of the present invention.

A secondary transfer roller 42 is disposed to face an appropriate portion of the intermediate transfer roller 41 (right below the intermediate transfer roller 41 in FIG. 1). The primarily transferred toner image which has been primarily transferred onto the intermediate transfer roller 41 is transported to a secondary transfer position 45 which is opposed against the secondary transfer roller 42, as the intermediate transfer roller 41 rotates. Meanwhile, the recording medium 4 housed in the paper cassette 3 is transported to the secondary transfer position 45 by a transportation driver (not shown), in synchronization to the transportation of the primarily transferred toner image. The secondary transfer roller 42 rotates approximately at the same circumferential speed as the intermediate transfer roller 41 in a direction which follows the intermediate transfer roller 41 (the clockwise direction in FIG. 1).

As the transfer bias generator 115 applies a secondary transfer bias (which may be −100 μA for example under constant current control) upon the secondary transfer roller 42, the toner image on the intermediate transfer roller 41 is secondarily transferred onto the recording medium 4. A cleaner 43 removes the liquid developer which remains on the intermediate transfer roller 41 after the secondary transfer. The recording medium 4 to which the toner image has been secondarily transferred in this manner is transported along a predetermined transfer paper transportation path 5 (denoted at the dashed line in FIG. 1), a fixing unit 6 fixes the toner image, and the recording medium 4 is discharged into a discharge tray which is disposed in an upper portion of the apparatus body 2. An operation display panel 7 comprising a liquid crystal display and a touch panel is disposed in a top surface of the apparatus body 2. The operation display panel 7 accepts an operation instruction from a user, and shows predetermined information to inform the user of the information.

A patch sensor 17 is disposed between the developer roller 31 and the intermediate transfer roller 41 which are around the photosensitive member 11 so that the patch sensor 17 is faced against the photosensitive member 11. As shown in FIGS. 2 and 3, the patch sensor 17 is a reflection-type optical sensor which comprises a light emitter 171 formed by an LED for instance and a light receiver 172 formed by a photo diode for instance. The angle of inclination of the optical axis of the light emitter 171 with respect to a normal line to the surface of the photosensitive member 11 is θ1 and thus equal to the angle of inclination θ1 of the optical axis of the light receiver 172 with respect to the normal line to the surface of the photosensitive member 11, as shown in FIG. 2. The light emitter 171 and the light receiver 172 are disposed respectively to bottom portions of thin holes which are formed along the optical axes of the light emitter 171 and the light receiver 172. With this structure, irradiation light from the light emitter 171 is regularly reflected by a patch image on the photosensitive member 11 and the regularly reflected light is received by the light receiver 172. As shown in FIG. 3, the light emitter 171, operating based on the control signal received from the CPU 113, irradiates light upon a patch image 18 (FIG. 4) which is formed on the photosensitive member 11, and the light receiver 172 receives the resulting regularly reflected light and sends a received-light signal corresponding to an image density to the CPU 113. In this embodiment, the patch sensor 17 corresponds to an "optical sensor" of the present invention.

In FIG. 3, the main controller 100 comprises an image memory 103 which stores an image signal fed from an external apparatus via the interface 102. The CPU 101, when receiving via the interface 102 a print instruction signal which contains an image signal from an external apparatus, converts the signal into job data which are in an appropriate format to instruct the engine section 1 to operate, and sends the data to the engine controller 110. A memory 116 of the engine controller 110 is formed by a ROM which stores a control program for the CPU 113 containing preset fixed data, a RAM which temporarily stores control data for the engine section 1, the result of a calculation performed by the CPU 113, etc. The CPU 113 stores within the memory 116 data regarding an image signal fed from an external apparatus via the CPU 101.

A memory 38 of the developer unit 30 is for storing data regarding a production lot of the developer unit 30, a history of use, characteristics of the toner inside, a remaining amount of the liquid developer 32, a toner density, etc. The memory 38 is electrically connected with a communication section 39 which is attached to the tank 33 for example. When the developer unit 30 is mounted to the apparatus body 2, the communication section 39 comes faced against a communication section 117 of the engine controller 110 over a predetermined distance, which may be 10 mm for instance, or a shorter distance, and as a result, the two can send data to and receive data from each other by a wireless communication such as one which uses an infrared ray while remaining not in contact with each other. The CPU 113 thus manages various types of information such as management of consumables related to the developer unit 30.

This embodiment requires to electromagnetic means such as a wireless communication for the purpose of attaining non-contact data transmission. An alternative however is to dispose one connector to each of the apparatus body 2 and the developer unit 30 and to mechanically engage the two connectors with each other by mounting the developer unit 30 to the apparatus body 2, whereby data transmission is realized between the apparatus body 2 and the developer unit 30. In addition, it is desirable that the memory 38 is a non-volatile memory which can save data even when a power source is off or the developer unit 30 is off the apparatus body 2. An EEPROM, such as a flash memory, a ferroelectric memory, or the like may be used as such a non-volatile memory.

Figure 4:
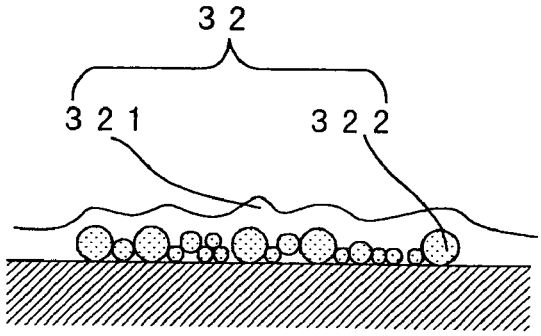
FIG. 4 is a drawing which shows concave and convex shapes which are formed on the surface of a liquid developer.
Figure 5:
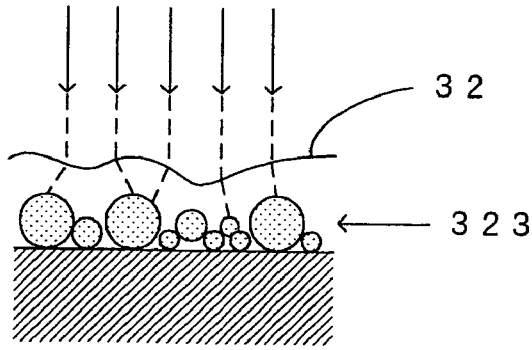
PRIOR ART FIG. 5
FIG. 5 is a drawing for describing variations of the direction of refraction of light at the surface of a liquid developer.

The shape of the surface of the liquid developer which is carried on a latent image carrier such as a photosensitive member and on a transfer medium such as a intermediate transfer roller will now be described. FIG. 4 is a drawing which shows concave and convex shapes which are formed on the surface of the liquid developer, and FIG. 5 is a drawing for describing variations of the direction of refraction of light at the surface of the liquid developer.

Of the liquid developer in which toner particles are dispersed in the carrier liquid, the toner particles on the latent image carrier are attracted to the surface of the latent image carrier because of a latent image potential (contrast potential) and accordingly form a bottom layer, and a layer of the carrier liquid is formed in a surface layer of the bottom layer. In a similar manner, on the transfer medium, the toner particles are attracted to the surface of the transfer medium owing to a transfer bias and accordingly form a bottom layer, and a layer of the carrier liquid is formed in a surface layer of the bottom layer.

This consequently transfers almost all of the toner particles onto the transfer medium, whereas a part of the carrier liquid remains on the latent image carrier and the remainder of the carrier liquid gets transferred onto the transfer medium. Hence, when a toner image is transferred from the latent image carrier onto the transfer medium, the amount of the carrier liquid contained in the liquid developer on the transfer medium decreases compared to that contained in the liquid developer on the latent image carrier of before-transfer, while the amount of the toner particles contained in the liquid developer on the transfer medium rarely changes compared to that contained in the liquid developer on the latent image carrier of before-transfer. Therefore, the high density/high viscosity liquid developer having a toner density of about 5 through 40 wt % becomes thicker and more viscous as the toner image is transferred.

In the case of a liquid developer whose viscosity is relatively low, the surface of the liquid developer carried on the latent image carrier or the like is believed to be smooth because of surface tension. However, as shown in FIG. 4 for instance, when a layer of a carrier liquid 321 in the surface layer becomes thin and the viscosity of the liquid developer 32 becomes higher by the decrease of the amount of the carrier liquid 321, concave and convex shapes which match with the shapes of toner particles 322 which are a solid component appear on the surface of the liquid developer 32. In other words, concave and convex shapes are created on the surface of the liquid developer which forms a patch image on the transfer medium, and the surface of the liquid developer fails to become smooth. In the event that concave and convex shapes have been created on the surface of the liquid developer which forms a patch image, as shown in FIG. 5 for example, when light (denoted at the arrow in FIG. 5) is irradiated upon a patch image 323, the direction of refraction of light (denoted at the broken line in FIG. 5) at the surface of the liquid developer 32 varies in accordance with the concave and convex shapes. When the direction of refraction of light varies, it is not possible for a light receiver to output a stable light signal.

In contrast, the liquid developer which forms a patch image on the latent image carrier has a lower viscosity than the liquid developer which forms a patch image on the transfer medium, and the amount of the carrier liquid contained in the liquid developer on the latent image carrier is large. Hence, the surface of the liquid developer which forms a patch image on the latent image carrier is less uneven than the surface of the liquid developer which forms a patch image on the transfer medium and is approximately smooth. As a result, the direction of refraction of light at the surface of the liquid developer is approximately constant when light is irradiated upon a patch image on the latent image carrier, and there arises almost no variation of the direction of refraction of light as compared with a patch image on the transfer medium.

Figure 6:
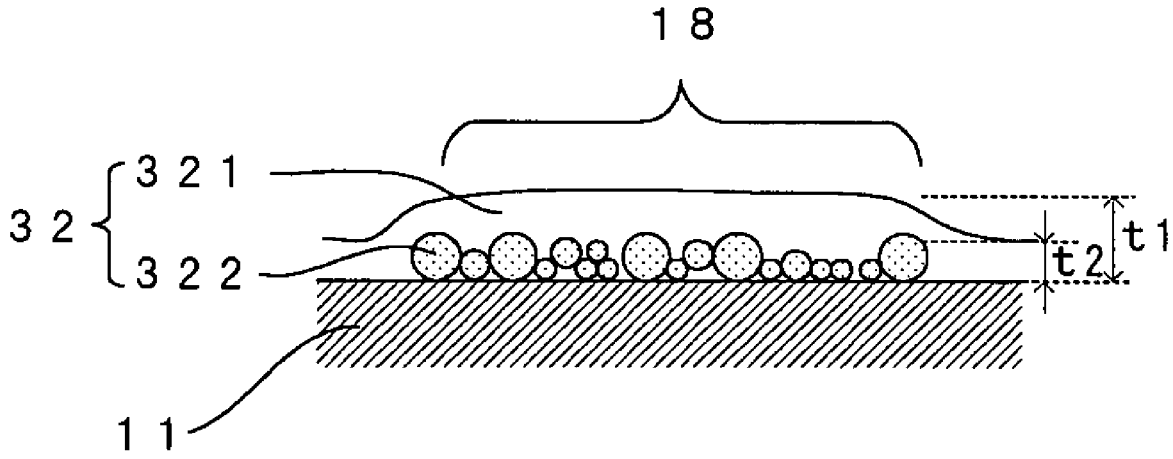
FIG. 6 is a drawing which shows a liquid developer layer which forms a patch image on a photosensitive member.

FIG. 6 is a drawing which shows a liquid developer layer which forms a patch image on the photosensitive member in this embodiment. A patch image 18 is formed like an ordinary toner image, except for that an image pattern is set in advance and the patch image 18 is not based on a print instruction signal fed from an external apparatus. That is, the liquid developer 32 in which the toner particles 322 are dispersed in the carrier liquid 321 is transported to the developing position 16, while carried on the surface of the developer roller 31. On the other hand, the charger 12 charges up the photosensitive member 11 uniformly to the potential Vd, and therefore, the toner particles 322 adhere to an area in which electric charges are neutralized by means of exposure with the light beam 21 from the exposure unit 20. In this embodiment, since the patch image 18 is a solid image, the toner particles 322 are densely lined up next to each other on the photosensitive member 11 as shown in FIG. 6, thereby forming the solid image.

In FIG. 6, an average thickness to of the layer of the liquid developer 32 in the patch image 18 formed on the photosensitive member 11 is set to be about twice as thick as an average thickness t2 of the layer of the toner particles 322. That is, $t1 \approx 2 \cdot t2$ or $(t1-t2) \approx t2$. The average thickness $(t1-t2)$ of the layer of the carrier liquid 321 corresponds to a value which is calculated by dividing the weight per unit surface area of the carrier liquid 321 on the photosensitive member 11 by the density of the carrier liquid 321. Meanwhile, the average thickness t2 of the layer of the toner particles 322 corresponds to a value which is calculated by dividing the weight per unit surface area of the toner particles 322 on the photosensitive member 11 by the density of the toner particles 322. The thickness values are set as described above, by adjusting the thickness of the liquid developer layer on the coating roller 34 which is restricted by the restricting blade 35, the development gap described earlier, the development nip distance described earlier, etc.

Figure 7:
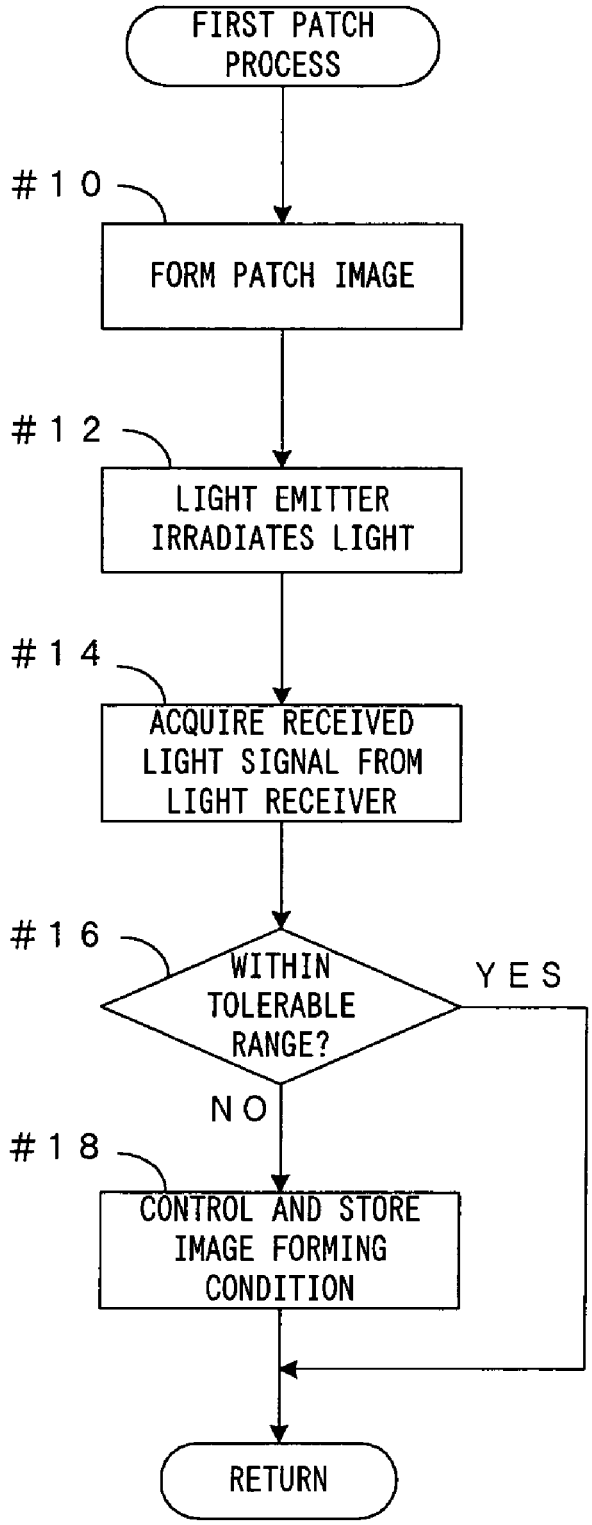
FIG. 7 is a flow chart which shows a patch process routine.

FIG. 7 is a flow chart which shows a patch process routine according to the first preferred embodiment. A control program for a first patch process is stored in the memory 116 of the engine controller 110. The following patch process is executed, as the CPU 113 controls the respective portions of the apparatus in accordance with this control program.

First, the patch image 18 is formed on the photosensitive member 11 (#10), the light emitter 171 irradiates light upon the patch image. 18 (#12), and the CPU 113 acquires the received-light signal from the light receiver 172 which has received light reflected by the patch image 18 (#14). Whether thus acquired received-light signal is within a tolerable range which has been set in advance is determined (#16). When the received-light signal is within the tolerable range (YES at #16), this routine is terminated. When the received-light signal is not within the tolerable range (NO at #16), image forming conditions are controlled, the controlled image forming conditions are written in the memory 116, and the image forming conditions stored in the memory 116 are consequently updated (#18).

Describing one example of how the image forming conditions are controlled, when the received-light signal from the light receiver 172 is found to be beyond the tolerable range at the step #16, it means that the patch image 18 has an insufficient density. Hence, the surface potential Vd is lowered, the exposure energy is enhanced, the developing bias Vb is increased and/or the toner density inside the tank 33 is increased for example. On the other hand, when the received-light signal from the light receiver 172 falls short of the tolerable range, it means that the patch image 18 has an excessive density. Hence, the respective parameters mentioned above are changed to the opposite.

The image forming conditions controlled in this manner may be written in the memory 38 of the developer unit 30. At appropriate timing, e.g., at the timing of receiving a print instruction signal for instance, the image forming conditions in the memory 38 may be written in the memory 116. In this embodiment, the CPU 113 thus corresponds to "control means" of the present invention.

Figure 8:
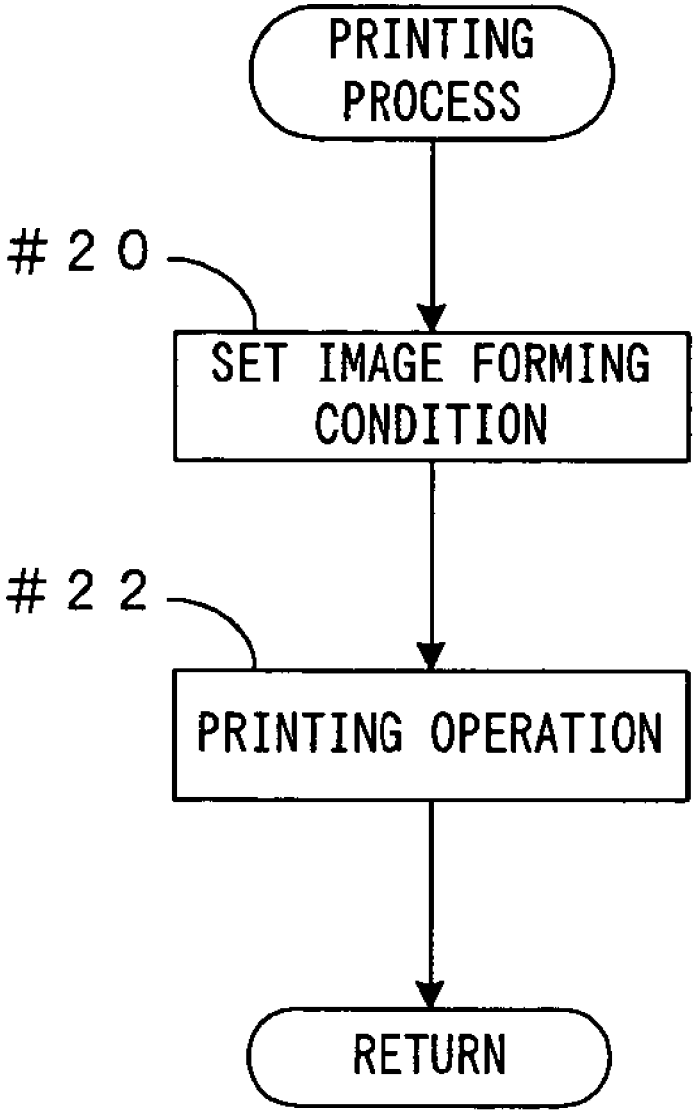
FIG. 8 is a flow chart which shows a printing process routine.

FIG. 8 is a flow chart which shows a printing process routine. As a print instruction signal is fed from an external apparatus via the main controller 100, first, the image forming conditions such as the charging bias Vd, the exposure energy and the developing bias Vb are set (#20). A printing operation is then executed under thus set image forming conditions (#22). Since the printing operation is executed under image forming conditions which have been controlled during the patch process, it is possible to form an image which has a high quality.

As described above, this embodiment requires to form the patch image 18 on the photosensitive member 11. Therefore, it is possible to ensure that the surface of the liquid developer 32 which forms the patch image 18 is approximately smooth, and hence, the direction of refraction of light at the surface of the liquid developer 32 stays almost constant instead of varying.

Meanwhile, the light receiver 172 receives the regularly reflected light by the patch image 18 which is irradiated by the light from the light emitter 171. Hence, the amount of the regularly reflected light received largely changes when the direction of refraction of light varies at the surface of the liquid developer 32 which forms the patch image 18.

However, according to this embodiment, since the direction of refraction of light at the surface of the liquid developer 32 which forms the patch image 18 stays almost constant without varying, the light receiver 172 can more securely receive the regularly reflected light by the patch image 18 illuminated by the light emitter 171, and hence, it is possible for the light receiver 172 to output a stable received-light signal. Thus, with the image forming conditions controlled based on the received-light signal from the light receiver 172, it is possible to set the image forming conditions to optimal and always form high-quality images while responding to a change of the state of the apparatus caused by a change with time, etc.

Further, in this embodiment, since the average thickness to of the layer of the liquid developer 32 is set to be twice as thick as the average thickness t2 of the layer of the toner particles 322, it is possible to ensure that the layer of the carrier liquid 321 having the thickness of the layer of the toner particles 322 is formed in the surface layer of the layer of the toner particles 322. Hence, it is possible to make the surface of the liquid developer 32 forming the patch image 18 approximately smooth without fail.

The present invention is not limited to the preferred embodiments described above, but may be modified in various manners in addition to the preferred embodiments described above, to the extent not deviating from the object of the invention.

For instance, although the first preferred embodiment described above requires that the intermediate transfer roller 41 is provided, and after a toner image on the photosensitive member 11 has been primarily transferred onto the intermediate transfer roller 41 at the primary transfer position 44, the secondary transfer roller 42 secondarily transfers the toner image onto the recording medium 4 at the secondary transfer position 45, this is not limiting. An alternative is to omit the intermediate transfer roller 41, dispose the secondary transfer roller 42 at the primary transfer position 44, and to transfer a toner image on the photosensitive member 11 directly onto the recording medium 4, for example, in which case the recording medium 4 corresponds to the transfer medium.

Further alternatively, the average thickness t1 of the layer of the liquid developer 32 may be set to be larger than twice the average thickness t2 of the layer of the toner particles 322. That is, t1>2·t2 or (t1−t2)>t2. According to this modification, since the layer of the carrier liquid 321 whose thickness is larger than that of the layer of the toner particles 322 can be formed in the surface layer of the layer of the toner particles 322, it is possible to more securely make the surface of the liquid developer 32 approximately smooth.

<Second Preferred Embodiment>

Figure 9:
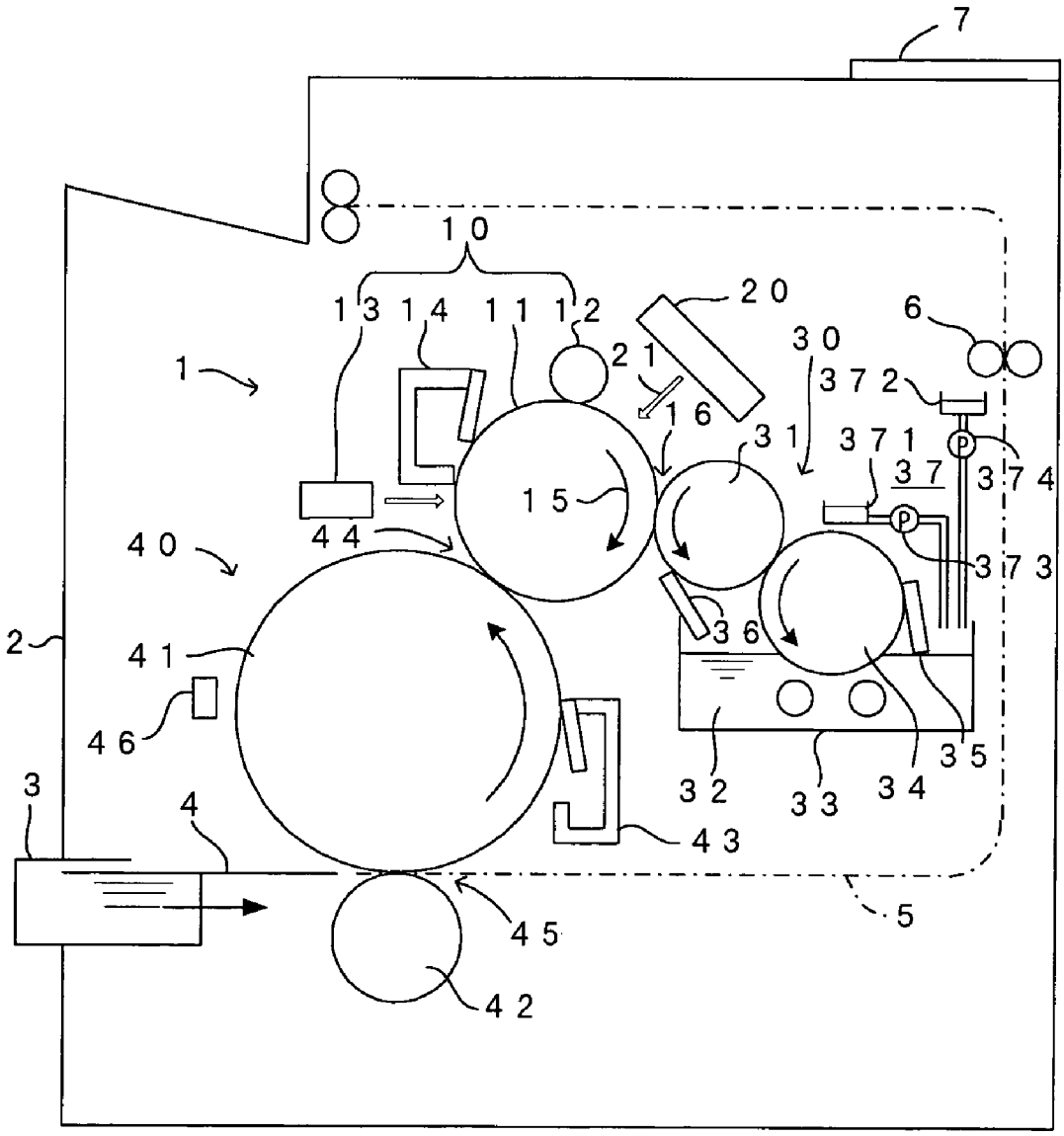
FIG. 9 is a drawing which shows an internal structure of a printer which is a second preferred embodiment of the present invention.
Figure 10:
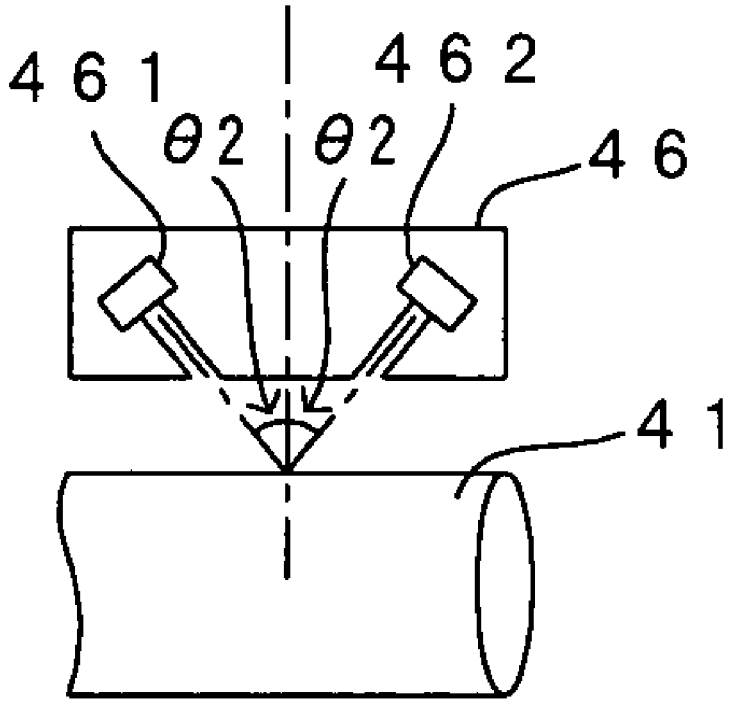
FIG. 10 is a drawing of a patch sensor which is disposed facing an intermediate transfer roller.
Figure 11:
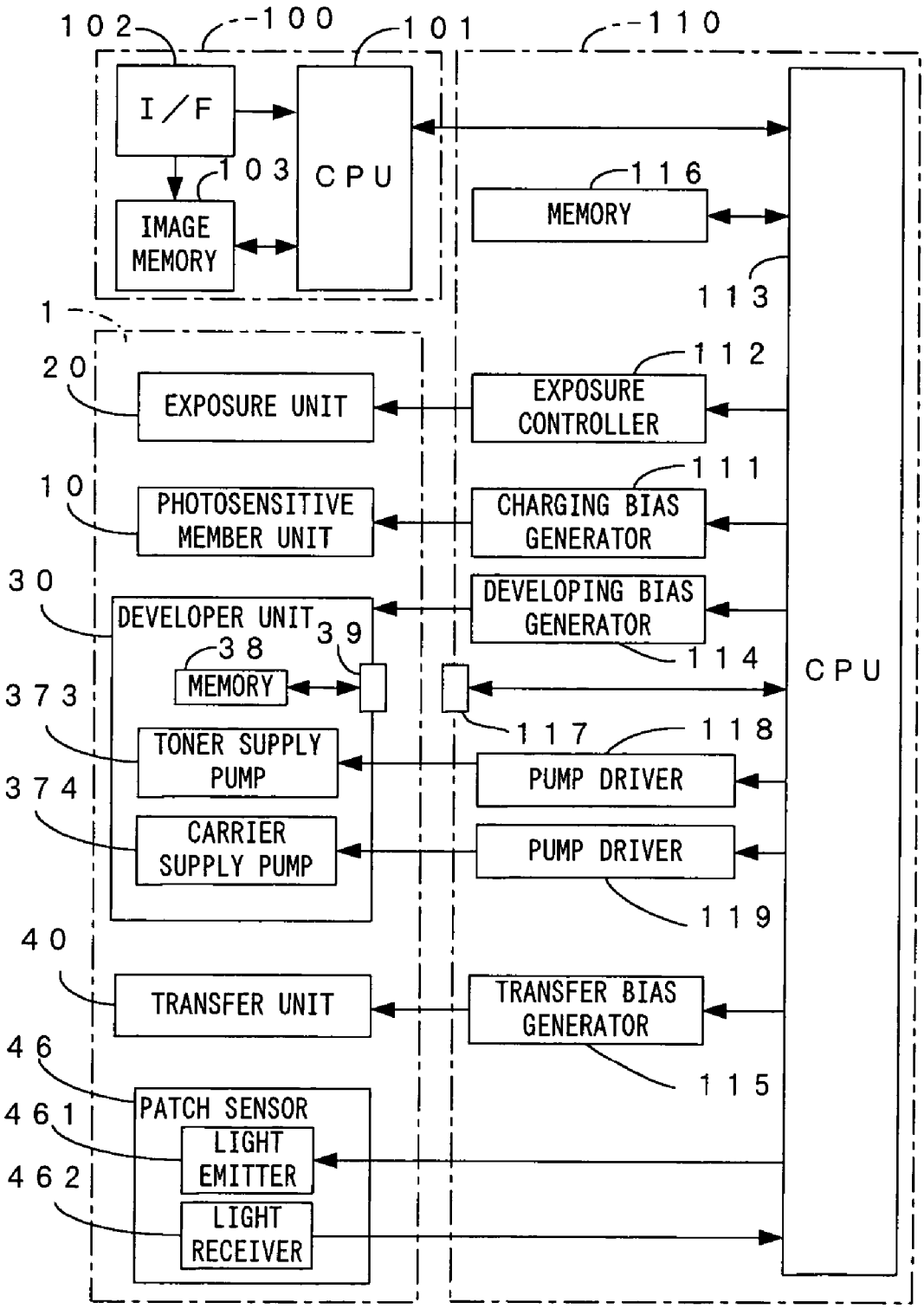
FIG. 11 is a block diagram which shows an electric structure of this printer.

FIG. 9 is a drawing which shows an internal structure of a printer which is a second preferred embodiment of the present invention, FIG. 10 is a drawing of a patch sensor which is disposed facing an intermediate transfer roller, and FIG. 11 is a block diagram which shows an electric structure of this printer. The second preferred embodiment is the same in structure as the first preferred embodiment, except for that the patch sensor 17 disposed facing the photosensitive member 11 is replaced with a patch sensor 46 which is disposed facing the intermediate transfer roller 41. Therefore, those elements having the same functions as those in the first preferred embodiment will be denoted at the same reference symbols and will not be described again.

The patch sensor 46 is disposed between the photosensitive member 11 and the secondary transfer roller 42 which are around the intermediate transfer roller 41 in such a manner that the patch sensor 46 is faced against the intermediate transfer roller 41. As shown in FIGS. 10 and 11, the patch sensor 46 is a reflection-type optical sensor which comprises a light emitter 461 formed by an LED for instance and a light receiver 462 formed by a photo diode for instance. As shown in FIG. 10, the angle of inclination of the optical axis of the light emitter 461 with respect to a normal line to the surface of the intermediate transfer roller 41 is θ2 and thus equal to the angle of inclination θ2 of the optical axis of the light receiver 462 with respect to the normal line to the surface of the intermediate transfer roller 41. The light emitter 461 and the light receiver 462 are disposed respectively to bottom portions of thin holes which are formed along the optical axes of the light emitter 461 and the light receiver 462. With this structure, irradiation light from the light emitter 461 is regularly reflected by a patch image on the intermediate transfer roller 41 and the regularly reflected light is received by the light receiver 462. As shown-in FIG. 11, the light emitter 461, operating based on the control signal received from the CPU 113, irradiates light upon a patch image 47 (FIG. 16) which has been transferred onto the intermediate transfer roller 41, and the light receiver 462 receives the resulting regularly reflected light and sends a received-light signal corresponding to an image density to the CPU 113.

Further, in the second preferred embodiment, the viscosity of the carrier liquid contained in the liquid developer 32 is 5 through 3000 mPa·s. While the viscosity of the liquid developer 32 is determined by the carrier liquid used, materials which forms toner, a toner density, etc., the viscosity of the liquid developer 32 is set to 50 through 6000 mPa·s for example in the second preferred embodiment.

In the second preferred embodiment, the developer roller 31 thus corresponds to a "liquid developer carrier" of the present invention, the developing bias generator 114 thus corresponds to "image forming means" of the present invention, the intermediate transfer roller 41 thus corresponds to the "transfer medium" of the present invention, the transfer bias generator 115 thus corresponds to "transfer means" of the present invention, and the patch sensor 46 thus corresponds to an "optical sensor" of the present invention.

Figure 12:
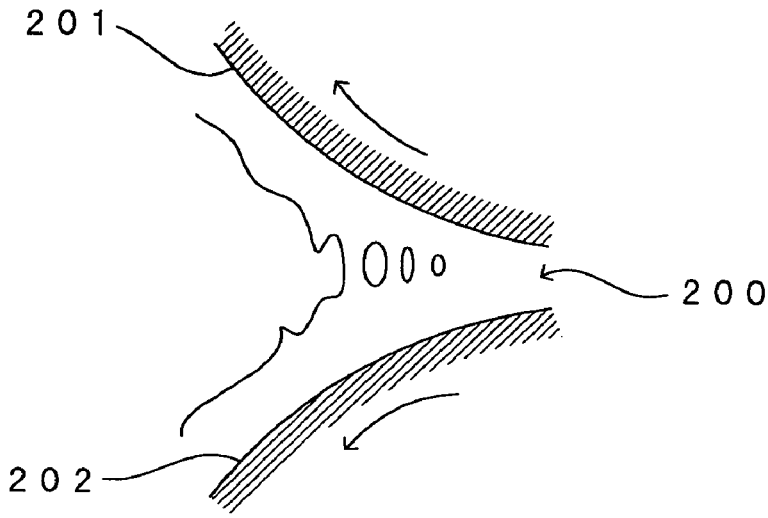
FIG. 12 is a drawing for describing a roping phenomenon.
Figure 13:
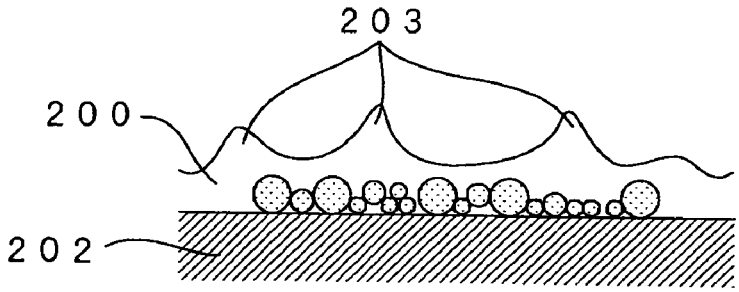
FIG. 13 is a drawing which shows concave and convex shapes which are formed on the surface of a liquid developer.
Figure 14:
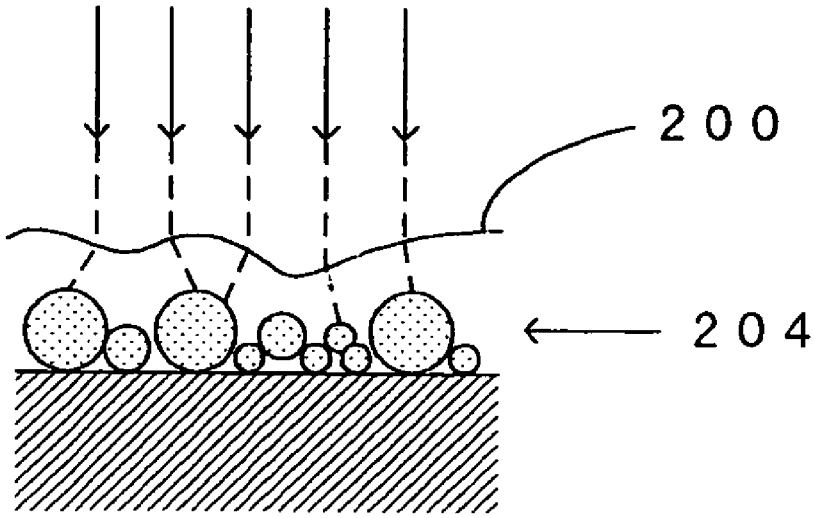
FIG. 14 is a drawing for describing variations of the direction of refraction of light at the surface of a liquid developer.

The shape of the surface of the liquid developer which is carried on the latent image carrier such as the photosensitive member and on the transfer medium such as the intermediate transfer roller will now be described. FIG. 12 is a drawing for describing a roping phenomenon, FIG. 13 is a drawing which shows concave and convex shapes which are formed on the surface of the liquid developer, and FIG. 14 is a drawing for describing variations of the direction of refraction of light at the surface of the liquid developer.

Of the liquid developer in which toner particles are dispersed in the carrier liquid, on the latent image carrier, the toner particles are attracted to the surface of the latent image carrier because of a latent image potential (contrast potential) and accordingly form a bottom layer, and a layer of the carrier liquid is formed in a surface layer of the bottom layer. In a similar manner, on the transfer medium, the toner particles are attracted to the surface of the transfer medium owing to a transfer bias and accordingly form a bottom layer, and a layer of the carrier liquid is formed in a surface layer of the bottom layer.

This consequently transfers almost all of the toner particles onto the transfer medium, whereas a part of the carrier liquid remains on the latent image carrier and the remainder of the carrier liquid gets transferred onto the transfer medium. Hence, when a toner image is transferred from the latent image carrier onto the transfer medium, the amount of the carrier liquid contained in the liquid developer on the transfer medium decreases compared to that contained in the liquid developer on the latent image carrier of before-transfer.

Supply of the liquid developer from the liquid developer carrier such as the developer roller onto the latent image carrier is realized, as the liquid developer carried by the liquid developer carrier is brought into contact with the latent image carrier at the developing position. The latent image potential applied during the contact makes the toner attracted to the surface of the latent image carrier, whereby a toner image formation (development) is realized. Following this, the liquid developer which has been in contact with both the liquid developer carrier and the latent image carrier separates into the liquid developer which remains adhering to the liquid developer carrier and the liquid developer which moves to the latent image carrier.

Transfer of a toner image from the latent image carrier onto the transfer medium is realized, as the liquid developer carried on the latent image carrier is brought into contact with the transfer medium at the transfer position and the transfer bias applied during the contact makes the toner attracted to the surface of the transfer medium. After this, the liquid developer which has been in contact with both the latent image carrier and the transfer medium separates into the liquid developer which remains adhering to the latent image carrier and the liquid developer which moves to the transfer medium.

In these situations, when the liquid developer has a high viscosity like a liquid developer whose toner density is about 5 through 40 wt %, as shown in FIG. 12 for instance, at the time of separation of a liquid developer 200 which has been in contact with both a liquid developer carrier 201 and a latent image carrier 202, a roping phenomenon occurs in which the liquid developer does not easily separate but becomes ropy and then separates. As the roping phenomenon occurs, as shown in FIG. 13 for example, the liquid developer 200 does not recover a smooth shape because of its high viscosity, and the surface of the liquid developer 200 defines concave and convex shapes of which ropy portions 302 are convex shapes. With the concave and convex shapes formed on the surface of the liquid developer which forms a patch image, as shown in FIG. 14 for instance, when light (denoted at the arrow in FIG. 14) is irradiated upon the patch image, the direction of refraction of light (denoted at the broken line in FIG. 14) varies at the surface of the liquid developer 200 in accordance with the concave and convex shapes. When the direction of refraction of light varies, it is impossible for a light receiver to output a stable received-light signal.

The larger the amount of the carrier liquid is, more easily the roping phenomenon occurs and the larger the sizes of convex shapes become. In short, when the liquid developer separates at the developing position toward the liquid developer carrier and the latent image carrier, since the amount of the carrier liquid is large, the roping phenomenon occurs easily. This easily gives rise to concave and convex shapes on the surface of the liquid developer which forms a patch image on the latent image carrier.

On the other hand, at the time that the liquid developer separates at the transfer position toward the latent image carrier and the transfer medium, since the amount of the carrier liquid is smaller than at the developing position, the roping phenomenon occurs less likely. Hence, the surface of the liquid developer forming a patch image on the transfer medium is less uneven than the surface of the liquid developer- forming a patch image on the latent image carrier and is approximately smooth. As a result, when light is irradiated upon a patch image on the transfer medium, the direction of refraction of light at the surface of the liquid developer becomes approximately constant and the refraction direction rarely varies as compared with a patch image on the latent image carrier.

Figure 15:
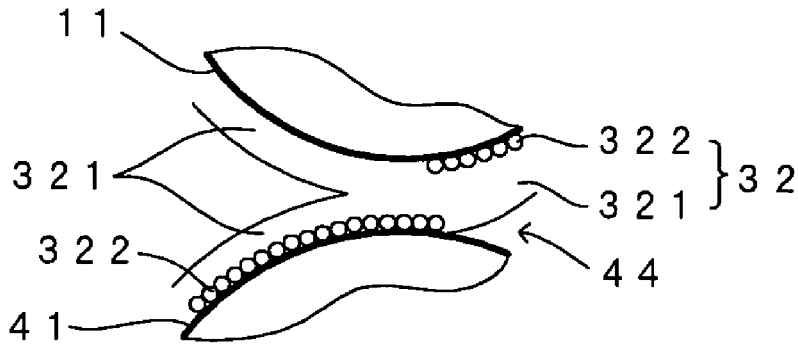
FIG. 15 is a drawing which shows a state in which a patch image is transferred onto an intermediate transfer roller from a photosensitive member.
Figure 16:
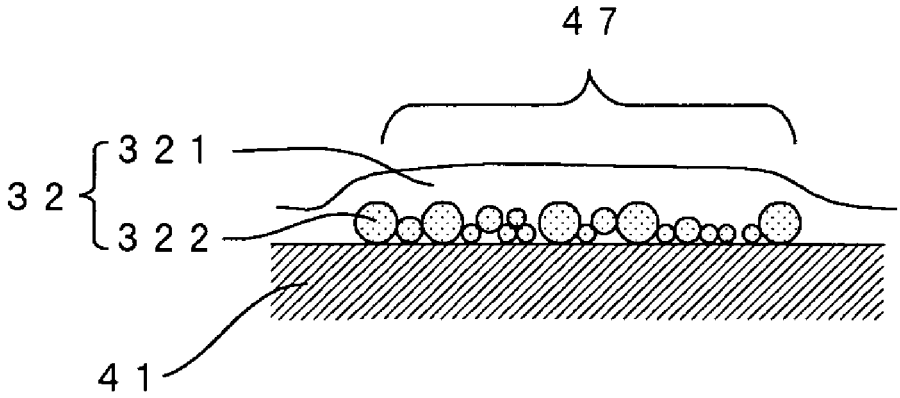
FIG. 16 is a drawing which shows a liquid developer layer which forms a patch image on the intermediate transfer roller.

FIG. 15 is a drawing which shows a state in which a patch image is transferred onto the intermediate transfer roller from the photosensitive member, and FIG. 16 is a drawing which shows a liquid developer layer which forms a patch image on the intermediate transfer roller.

A patch image is formed on the photosensitive member 11 and transferred onto the intermediate transfer roller 41 like an ordinary toner image, other than that an image pattern is set in advance and the patch image is not based on a print instruction signal which is fed from an external apparatus. That is, as shown in FIG. 15, the toner particles 322 are attracted to the surface of the photosensitive member 11 and then transported to the primary transfer position 44 with the carrier liquid 321 lying on top of the surface layer of the toner particles 322. Owing to the primary transfer bias applied from the transfer bias generator 115, the toner particles 322 then move from the photosensitive member 11 and get attracted to the surface of the intermediate transfer roller 41. While the carrier liquid 321 thereafter separates as the photosensitive member 11 and the intermediate transfer roller 41 rotate, since the amount of the carrier liquid is smaller at the primary transfer position 44 than at the developing position 16, the roping phenomenon does not occur at the time of the separation as shown in FIG. 15. The surface of the liquid developer 32 forming the patch image 47 on the intermediate transfer roller 41 consequently becomes approximately smooth as shown in FIG. 16. In this embodiment, since the patch image 47 is a solid image, the toner particles 322 are densely lined up next to each other on the intermediate transfer roller 41 as shown in FIG. 16, thereby forming the solid image.

Figure 17:
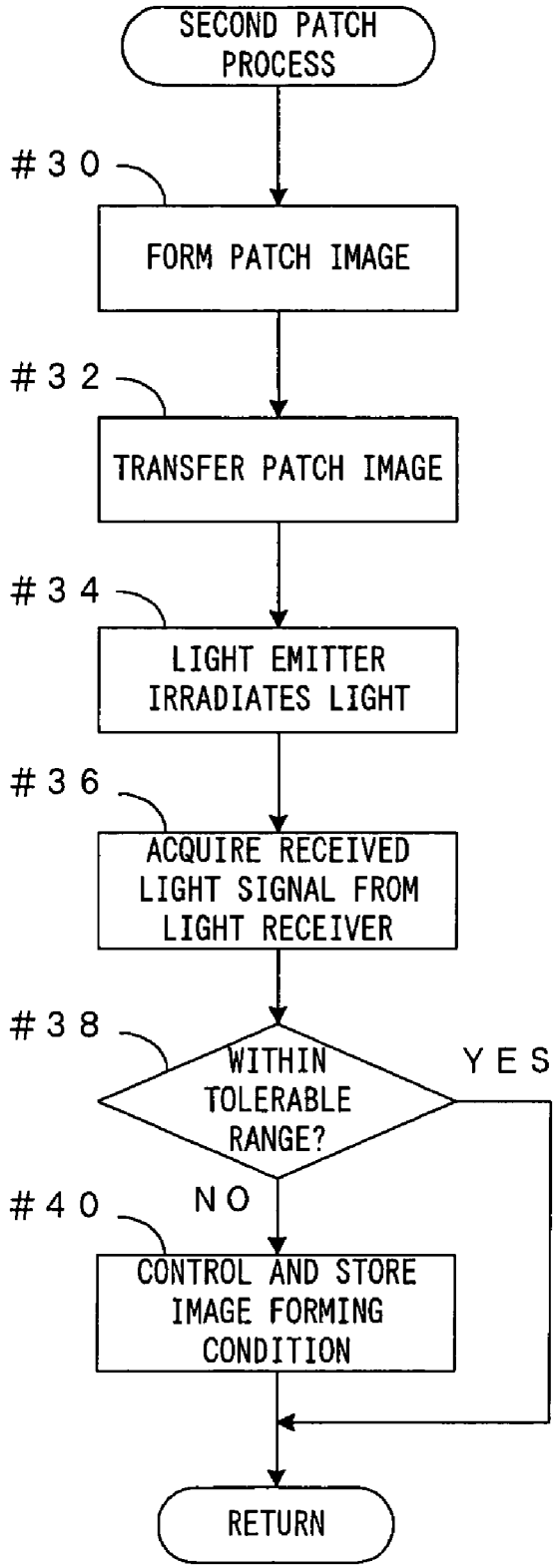
FIG. 17 is a flow chart which shows a patch process routine.

FIG. 17 is a flow chart which shows a patch process routine in the second preferred embodiment. A control program for a second patch process is stored in the memory 116 of the engine controller 110. The following patch process is executed, as the CPU 113 controls the respective portions of the apparatus in accordance with this control program.

First, the patch image 47 is formed on the photosensitive member 11 (#30), the patch image 47 is transferred onto the intermediate transfer roller 41 from the photosensitive member 11 (#32). The light emitter 461 irradiates light upon the patch image 47 which is on the intermediate transfer roller 41 (#34), and the CPU 113 acquires the received-light signal from the light receiver 462 which has received light reflected by the patch image 47 (#36). Whether thus acquired received-light signal is within a tolerable range which has been set in advance is determined (#38). When the received-light signal is within the tolerable range (YES at #38), this routine is terminated. When the received-light signal is not within the tolerable range (NO at #38), image forming conditions are controlled, the controlled image forming conditions are written in the memory 116, and the image forming conditions stored in the memory 116 are consequently updated (#40).

Describing one example how the image forming conditions are controlled, when the received-light signal from the light receiver 462 is found to be beyond the tolerable range at the step #38, it means that the patch image 47 has an insufficient density. Hence, the surface potential Vd is lowered, the exposure energy is enhanced, the developing bias Vb is increased and/or the toner density inside the tank 33 is increased for example. On the other hand, when the received-light signal from the light receiver 462 is less than the tolerable range, it means that the patch image 47 has an excessive density. Hence, the respective parameters mentioned above are changed to the opposite.

The image forming conditions controlled in this manner may be written in the memory 38 of the developer unit 30. At appropriate timing, e.g., at the timing of receiving a print instruction signal for instance, the image forming conditions in the memory 38 may be written in the memory 116. In this embodiment, the CPU 113 thus corresponds to "control means" of the present invention.

Figure 18:
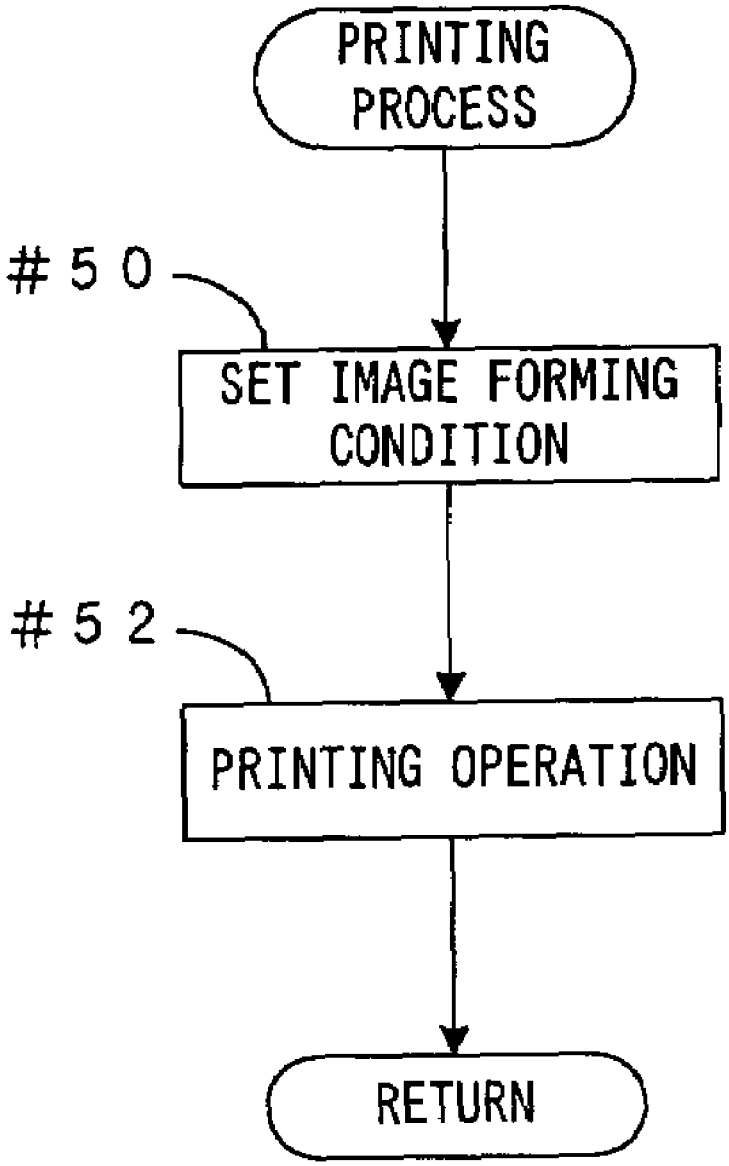
FIG. 18 is a flow chart which shows a printing process routine.

FIG. 18 is a flow chart which shows a printing process routine. As a print instruction signal is fed from an external apparatus via the main controller 100, first, the image forming conditions such as the charging bias Vd, the exposure energy and the developing bias Vb are set (#50). A printing operation is then executed under thus set image forming conditions (#52). Since the printing operation is executed under image forming conditions which have been controlled during the patch process, it is possible to form an image which has a high quality.

As described above, this embodiment requires that the light emitter 461 irradiates light upon the patch image 47 which is on the intermediate transfer roller 41, the surface of the liquid developer 32 which forms the patch image 47 becomes approximately smooth. Hence, the direction of refraction of light at the surface of the liquid developer 32 stays almost constant instead of varying.

Meanwhile, the light receiver 462 receives the regularly reflected light by the patch image 47 which is irradiated by the light from the light emitter 461, and therefore, the amount of the regularly reflected light received largely changes as the direction of refraction of light varies at the surface of the liquid developer 32 which forms the patch image 47.

However, according to this embodiment, since the direction of refraction of light at the surface of the liquid developer 32 which forms the patch image 47 stays almost constant without varying, the light receiver 462 can more securely receive the regularly reflected light by the patch image 47 illuminated by the light emitter 461, and hence, it is possible for the light receiver 462 to output a stable received-light signal. Thus, with the image forming conditions controlled based on the received-light signal from the light receiver 462, it is possible to set the image forming conditions to optimal and always form high-quality images while responding to a change of the state of the apparatus caused by a change with time, etc.

Further, in the second preferred embodiment, the viscosity of the carrier liquid contained in the liquid developer 32 is about 5 through 3000 mPa·s, which is preferable. The reason is as follows: When the viscosity becomes about 3000 mPa·s or higher, the roping phenomenon occurs easily because of the excessively high viscosity. On the other hand, when the viscosity is about 5 mPa·s or lower, the volatility of the carrier liquid is too high and a structure for preventing leakage of the carrier liquid out of the apparatus becomes necessary and the structure of the apparatus accordingly becomes complex.

Although the viscosity of the carrier liquid is about 5 through 3000 mPa·s in this embodiment, the viscosity of the liquid developer 32 including the toner may be about 50 through 6000 mPa·s.

The present invention is not limited to the preferred embodiments described above, but may be modified in various manners in addition to the preferred embodiments described above, to the extent not deviating from the object of the invention.

For instance, although the second preferred embodiment described above requires that the intermediate transfer roller 41 is provided, and after a toner image on the photosensitive member 11 has been primarily transferred onto the intermediate transfer roller 41 at the primary transfer position 44, the secondary transfer roller 42 secondarily transfers the toner image onto the recording medium 4 at the secondary transfer position 45, this is not limiting. An alternative is to omit the intermediate transfer roller 41, dispose the secondary transfer roller 42 at the primary transfer position 44, and to transfer a toner image on the photosensitive member 11 directly onto the recording medium 4, for example. In such an alternative structure, the patch sensor 46 may be disposed facing the recording medium 4 onto which the patch image is already transferred, in which case the recording medium 4 corresponds to the "transfer medium" of the present invention.

In addition, while the foregoing has described the first and the second preferred embodiments in relation to a printer which prints on a transfer paper an image fed from an external apparatus such as a host computer, the present invention is not limited to this but is applicable to electrophotographic image forming apparatuses in general including copier machines, facsimile machines and the like. Further, the preferred embodiments above are directed to an application of the present invention to an image forming apparatus which prints in monochrome, applications of the present invention are not limited to this. Rather, the present invention is applicable also to an image forming apparatus which prints in colors.

Although the invention has been described with reference to specific embodiments, this description is not meant to be construed in a limiting sense. Various modifications of the disclosed embodiments, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus wherein a latent image on a latent image carrier is developed using a liquid developer, in which toner particles are dispersed in a carrier liquid and of which toner density is about 5 through 40 wt %, thereby forming a toner image, and the toner image is transferred onto a transfer medium, said apparatus comprising:

an optical sensor including a light emitter which irradiates light upon a toner image formed as a patch image on said latent image carrier, and a light receiver which receives light from the patch image; and control means controlling an image forming condition which influences a toner image density based on a received-light signal from said light receiver, wherein an average thickness of a layer of the carrier liquid in the patch image formed on said latent image carrier is larger than an average thickness of a layer of the toner particles.

2. The image forming apparatus of claim 1, wherein said light receiver receives regularly reflected light by the patch image which is irradiated by the light from said light emitter.

3. An image forming method wherein a latent image on a latent image carrier is developed using a liquid developer, in which toner particles are dispersed in a carrier liquid and of which toner density is about 5 through 40 wt %, thereby forming a toner image, and the toner image is transferred onto a transfer medium, said method comprising the steps of:

irradiating light upon a toner image formed as a patch image on said latent image carrier;

receiving light from the patch image; and controlling an image forming condition which influences a toner image density based on a received-light signal, wherein an average thickness of a layer of the carrier liquid in the patch image formed on said latent image carrier is larger than an average thickness of a layer of the toner particles.

* * * * *